US009944437B2

(12) United States Patent
Lin

(10) Patent No.: US 9,944,437 B2
(45) Date of Patent: Apr. 17, 2018

(54) COVER STRUCTURE OF CONTAINER

(71) Applicant: Tsai-Hui Lin, Kaohsiung (TW)

(72) Inventor: Tsai-Hui Lin, Kaohsiung (TW)

( * ) Notice: Subject to any disclaimer, the term of this patent is extended or adjusted under 35 U.S.C. 154(b) by 131 days.

(21) Appl. No.: 15/149,678

(22) Filed: May 9, 2016

(65) Prior Publication Data

US 2017/0057707 A1 Mar. 2, 2017

(30) Foreign Application Priority Data

Aug. 28, 2015 (TW) ..... 104214013 U

(51) Int. Cl.

| | |
|---|---|
| ***A47G 19/22*** | (2006.01) |
| ***B65D 43/22*** | (2006.01) |
| ***B65D 43/02*** | (2006.01) |
| ***B65D 43/16*** | (2006.01) |
| ***B65D 51/18*** | (2006.01) |

(52) U.S. Cl.

CPC ..... *B65D 43/22* (2013.01); *B65D 43/02* (2013.01); *B65D 43/16* (2013.01); *B65D 51/18* (2013.01); *B65D 2251/009* (2013.01); *B65D 2251/0021* (2013.01); *B65D 2251/0028* (2013.01); *B65D 2251/0081* (2013.01)

(58) Field of Classification Search

CPC ..... B65D 43/22; B65D 51/18; B65D 43/16; B65D 43/02; B65D 2251/009; B65D 2251/0081; B65D 2251/0028; B65D 2251/0021; A47G 19/2272

USPC ..... 220/254.3, 715, 833–835

See application file for complete search history.

(56) References Cited

U.S. PATENT DOCUMENTS

| | | | | |
|---|---|---|---|---|
| 5,908,037 | A * | 6/1999 | Pierson | A45D 33/006 132/293 |
| 2002/0036207 | A1* | 3/2002 | Ohuo | A47G 19/2266 220/830 |
| 2003/0136783 | A1* | 7/2003 | Hatsumoto | A47G 19/2266 220/254.3 |
| 2013/0248531 | A1* | 9/2013 | Lane | A45C 11/20 220/262 |

* cited by examiner

*Primary Examiner* — James N Smalley
(74) *Attorney, Agent, or Firm* — Rosenberg, Klein & Lee

(57) ABSTRACT

A cover structure of a container is provided. The cover structure has a bottom cover assembled on an opening of the container's body, a top cover openably and pivotally connected with the bottom cover to simultaneously cover the bottom cover and an outlet of a watering seat assembled on the opening of the container's body, and a latch mechanism disposed between the top cover and the bottom cover. The latch mechanism has a first latch seat assembled on the top cover, a second latch seat elastically, horizontally and movably assembled between a first position and a second position of the bottom cover, and a sliding latch bolt vertically and slidably assembled between a third position and a fourth position of the second latch seat.

15 Claims, 10 Drawing Sheets

COVER STRUCTURE OF CONTAINER

BACKGROUND

Field of Invention

This invention is related to a cover structure of a container. More particularly, this invention is related to a single-hand operable cover structure.

Description of Related Art

The cover structure of the current common existing containers has a thread segment, and the opening of the container's body also has a corresponding thread segment. When the cover structure covers the container's body, the thread segments of the cover structure and the container body's opening can be rotated and latched to prevent the liquid in the container's body from leaking out. However, this way of latching or unlatching the corresponding thread segments needs both hands to operate at the same time. Therefore, it is unfavorable for a user has only one hand that can be used.

In the market, there is another cover structure including a ring seat, a top cover, and a fastener. The ring seat is disposed near the opening of the container's body. The top cover is pivotally connected to the ring seat. The fastener is disposed between the ring seat and the top cover. When the top cover is closed, the top cover can be opened by only pressing the fastener. This structure design can open and close the top cover by one hand, but the fastener does not have any latch mechanism. Hence, the top cover can be easily opened by inadvertently touch the fastener to let the drink in the container's body leak out and thus produce trouble for the user.

For solving the above problem that the top cover cannot be opened by one hand or that the fastener can be inadvertently touched to open the top cover and cause the drink leak out, this invention provides a cover structure that can be operated by one hand along an arc line and has a latch mechanism to facilitate a user using this cover structure and avoid inadvertently touch the fastener to open the top cover cause the drink leak out.

SUMMARY

A main aspect of this invention is to provide a cover structure of a container. The cover structure can be opened and closed by a single hand to facilitate users. Furthermore, the cover structure has a latch mechanism to avoid opening the top cover by an inadvertently touch and cause that the drink flow out from the container.

The aspects and functions are accomplished by the following means.

This invention is related to a cover structure of a container. The cover structure comprises a bottom cover, a top cover, and a latch mechanism. The bottom cover is assembled on an opening of a body of the container. The top cover is openably and pivotally connected with the bottom cover to simultaneously cover the bottom cover and an outlet of a watering seat assembled on the opening of the container's body. The latch mechanism is disposed between the top cover and the bottom cover and comprises a first latch seat, a second latch seat, and a sliding latch bolt. The first latch seat is assembled on the top cover and has a first buckle hook and a slot. The second latch seat is elastically and horizontally movably assembled between a first position and a second position of the bottom cover, wherein the second latch seat has a second buckle hook to hook the first buckle hook when the second latch seat is positioned in the first position, and the second buckle hook is detached from the first buckle hook when the second latch seat is positioned in the second position. The sliding latch bolt is vertically slidably assembled between a third position and a fourth position of the second latch seat, wherein the sliding latch bolt comprises a cog inserted into the slot when the sliding latch bolt is positioned in the third position, and the cog detaches from the slot when the sliding latch bolt is positioned in the fourth position.

The advantage of this invention includes:

1. The latch mechanism of this invention latch the first latch seat through the sliding latch bolt, and the first latch seat is then engaged by the second latch seat. Therefore, the latch mechanism has a toggle switch with double latches to avoid inadvertently opening the top cover.

2. When the sliding latch bolt is released from the latched state to release the first latch seat and the second latch seat, only the second latch seat being plucked along the arc direction of the container's body is needed to open the top cover. Therefore, the operation is quite convenient. Moreover, the operation along the arc direction of the container's body can avoid the user from forgetting to latch the sliding latch bolt and inadvertently touch the second latch seat to open the top cover.

3. The sliding latch bolt is a toggle switch with double latches. The sliding latch bolt can be easily installed to be a safely latched bolt.

4. When the top cover is closed, the top cover is also automatically latched through the latch mechanism at the same time.

DETAILED DESCRIPTION

Figure 1:
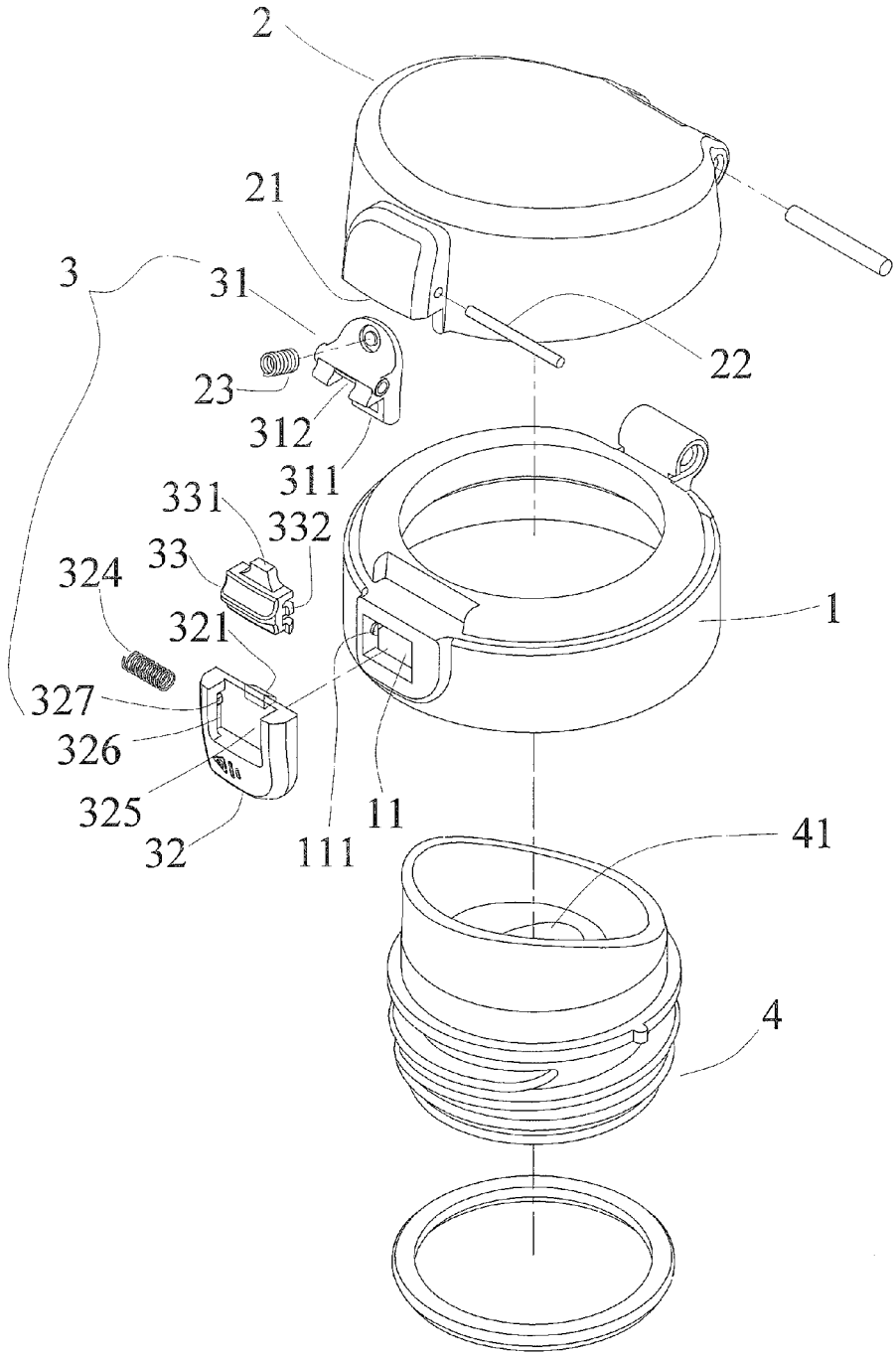
FIG. 1 is a front perspective exploded view of a cover structure and a watering seat of a container in this invention.
Figure 2:
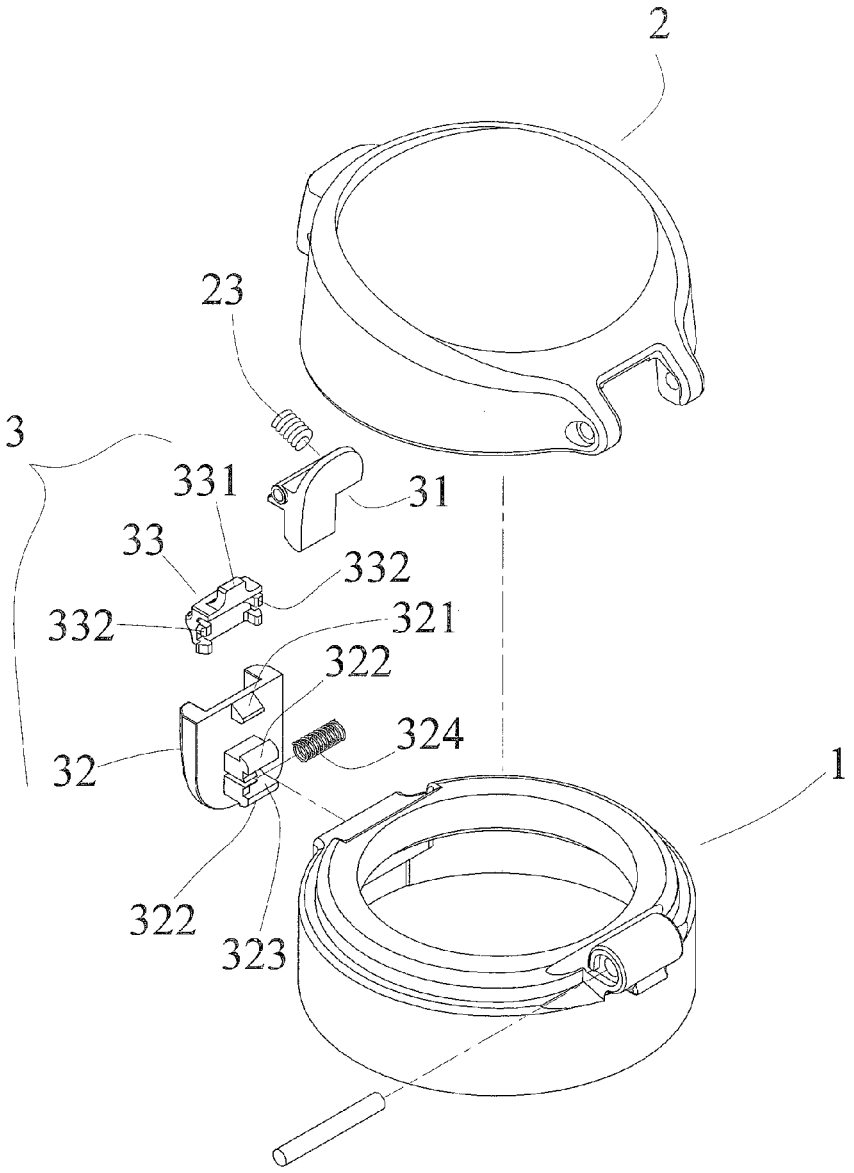
FIG. 2 is a rear perspective exploded view of a cover structure of a container in this invention.

In this invention, the cover structure mainly comprises a bottom cover 1, a top cover 2, and a latch mechanism 3.

The bottom cover 1 is assembled on an opening of a body of the container. The top cover 2 is openably and pivotally connected with the bottom cover 1 to simultaneously cover the bottom cover 1 and an outlet 41 of a watering seat 4 assembled on the body of the container. The latch mechanism 3 is disposed between the top cover 2 and the bottom cover 1.

The latch mechanism 3 comprises a first latch seat 31, a second latch seat 32, and a sliding latch bolt 33. The first latch seat 31 is assembled on the top cover 2. The second latch seat 32 can be elastically and horizontally movably assembled between a first position and a second position of the bottom cover 1. The first position means that the second latch seat 32 is in a latched position, and the second position means that the second latch seat 32 is in a released position. The sliding latch bolt 33 is assembled on the second latch seat 32 and slides between a third position and a fourth position of the second latch seat 32. The third position means that the sliding latch bolt 33 is in a latched position, and the fourth position means that the sliding latch bolt 33 is in a released position.

The top cover 2 has an opening toward a room 21 of the bottom cover 1, wherein the room 21 receives the first latch seat 31. A pivot 22 horizontally penetrates a right sidewall and a left sidewall of the room 21, as well as the first latch seat 31 to assemble the first latch seat 31 in the room 21. A first elastic element 23 is assembled between a front sidewall of the room 21 and a first end of the first latch seat 31, and the first end of the first latch seat 31 is elastic to a second end that is opposite to the first end. The first latch seat 31 has a first buckle hook 311 and a slot 312 are located on the second end of the first latch seat 31. The first buckle hook 311 projects from the room 21 of the top cover 2 to be exposed by the top cover 2.

The second latch seat 32 has a second buckle hook 321 correspondingly to the first buckle hook 311 of the first latch seat 31. When the second latch seat 32 is positioned in the first position, the first buckle hook 311 and the second buckle hook 321 can be hooked together. When the second latch seat 32 is positioned in the second position, the second buckle hook 321 is detached from the first buckle hook 311. Furthermore, the second latch seat 32 only can be moved from the first position to the second position when the sliding latch bolt 33 is in the fourth position.

The bottom cover 1 has a through slot 11 penetrating the walls of the bottom cover 1. Two hooks 322 are disposed on terminal surfaces of the second latch seat 32 toward the through slot 11 to extend into the through slot 11 and hook the top and bottom peripheral edges of the through slot 11. Therefore, the second latch seat 32 can be assembled on the bottom cover 1. Moreover, a space 323 is formed between the two hooks 322 to receive a second elastic element 324. The two terminals of the second elastic element 324 are against the sidewalls of the through slot 11 and the second latch seat 32. Thus, the second latch seat 32 has an ability to move horizontally and elastically. Furthermore, the sidewalls of the through slot 11 have positioning bumps 111 disposed thereon to be respectively sleeved in two terminals of the second elastic element 324 to locate the second elastic element 324.

The second latch seat 32 has a recessed slot 325 disposed on a surface opposite to the terminal surface of the through slot 11 for receiving the sliding latch bolt 33.

The left and right sidewalls of the recessed slot 325 of the second latch seat 32 each has a sliding groove 326. The sliding grooves 326 each has a first bump 327 to divide the sliding groove 326 into the third position and the fourth position. The left and right sidewalls of the sliding latch bolt 33 each has a second bump 332. When the sliding latch bolt 33 is installed in the recessed slot 325, the second bumps 332 are just in the sliding grooves 326 and can cross the first bumps 327 upward or downward to the third position or the fourth position.

The sliding latch bolt 33 comprises a cog 331 corresponding to the slot 312 of the first latch seat 31. The cog 331 is inserted into the slot 312 when the sliding latch bolt 33 is positioned in the third position, and the cog 331 is escaped from the slot 312 to be in an unlatched situation when the sliding latch bolt 33 is positioned in the fourth position.

Figure 3:
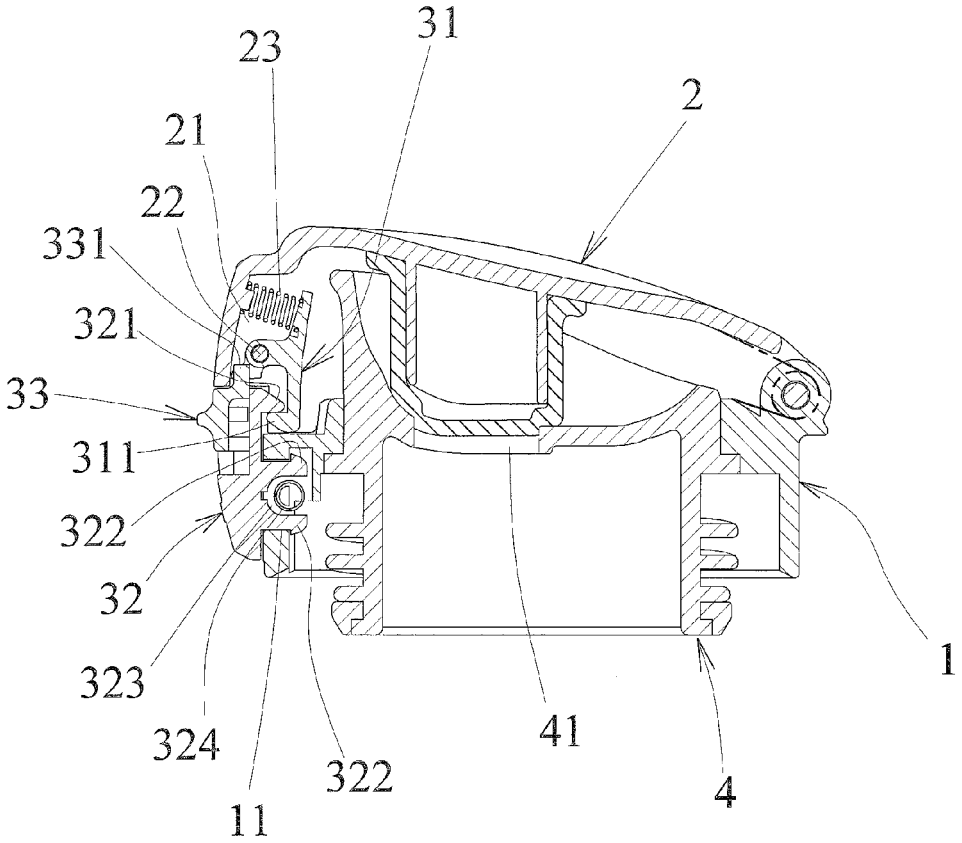
FIG. 3 is a diagram showing a lateral view when the first latch seat, the second latch seat and the sliding latch bolt are in a latched state as the top cover covering the bottom cover according to this invention.
Figure 4:
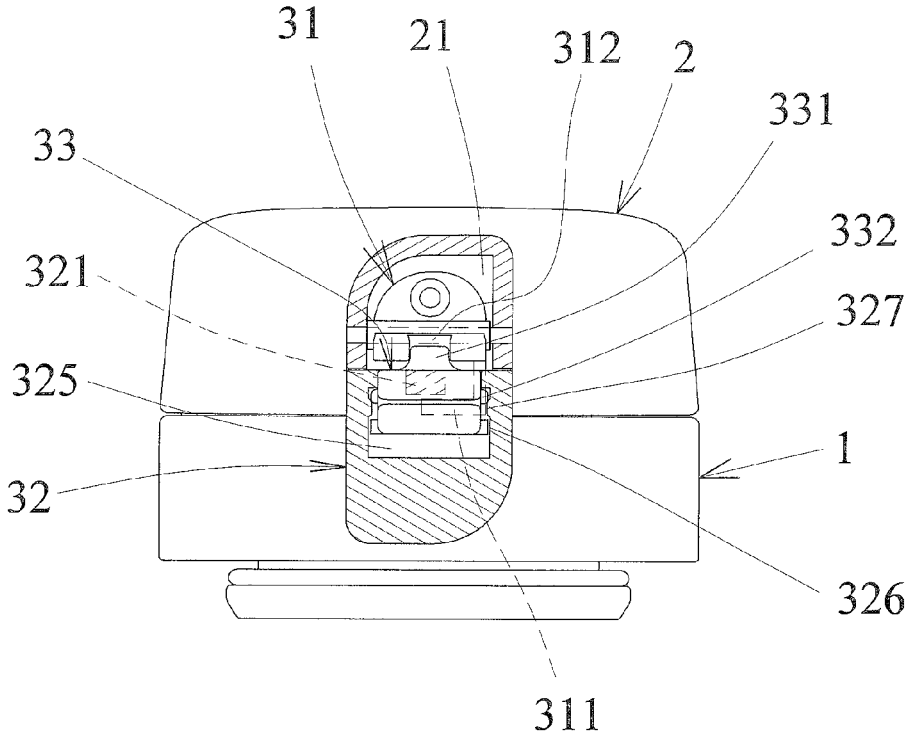
FIG. 4 is a diagram showing a front view when the first latch seat, the second latch seat and the sliding latch bolt are in a latched state as the top cover covering the bottom cover according to this invention.
Figure 5:
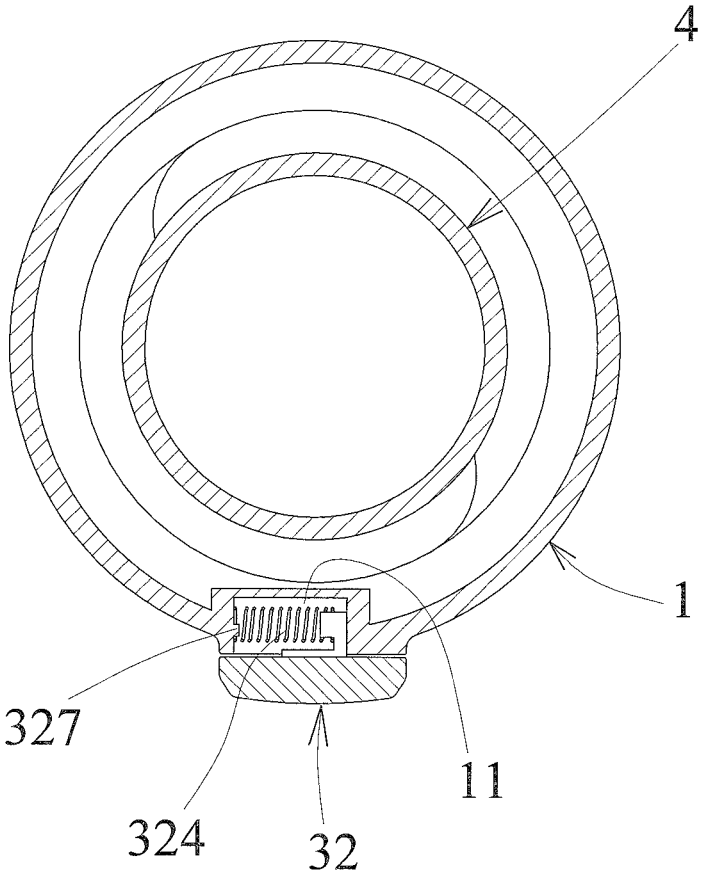
FIG. 5 is a diagram showing a top view when the first latch seat, the second latch seat and the sliding latch bolt are in a latched state as the top cover covering the bottom cover according to this invention.
Figure 6:
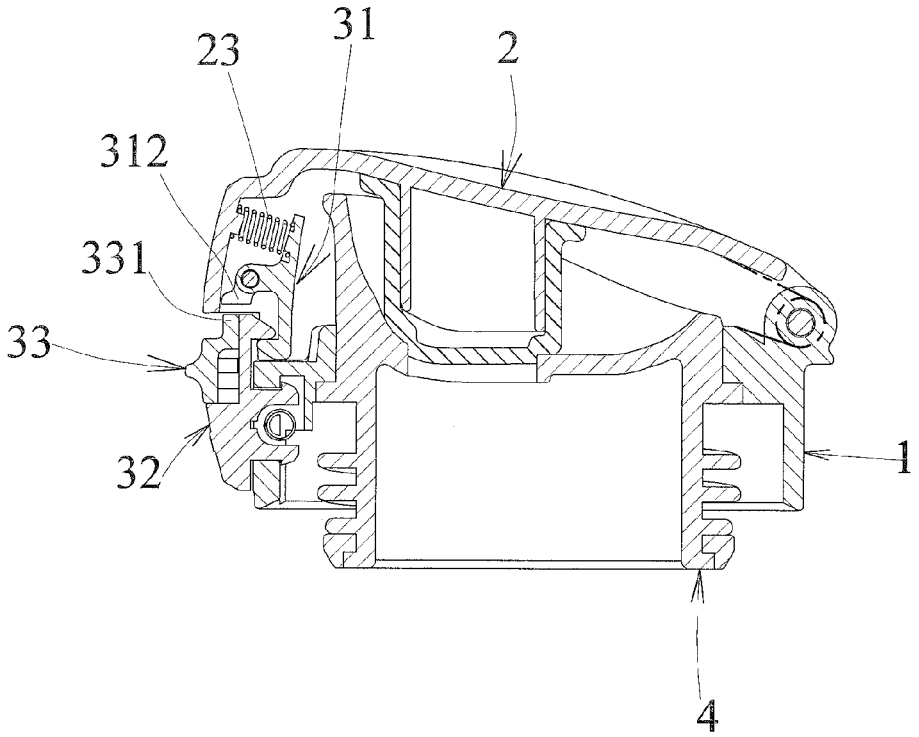
FIG. 6 is a diagram showing a lateral view of the relation between the first latch seat, the second latch seat, and the sliding latch bolt after moving down the sliding latch bolt.
Figure 7:
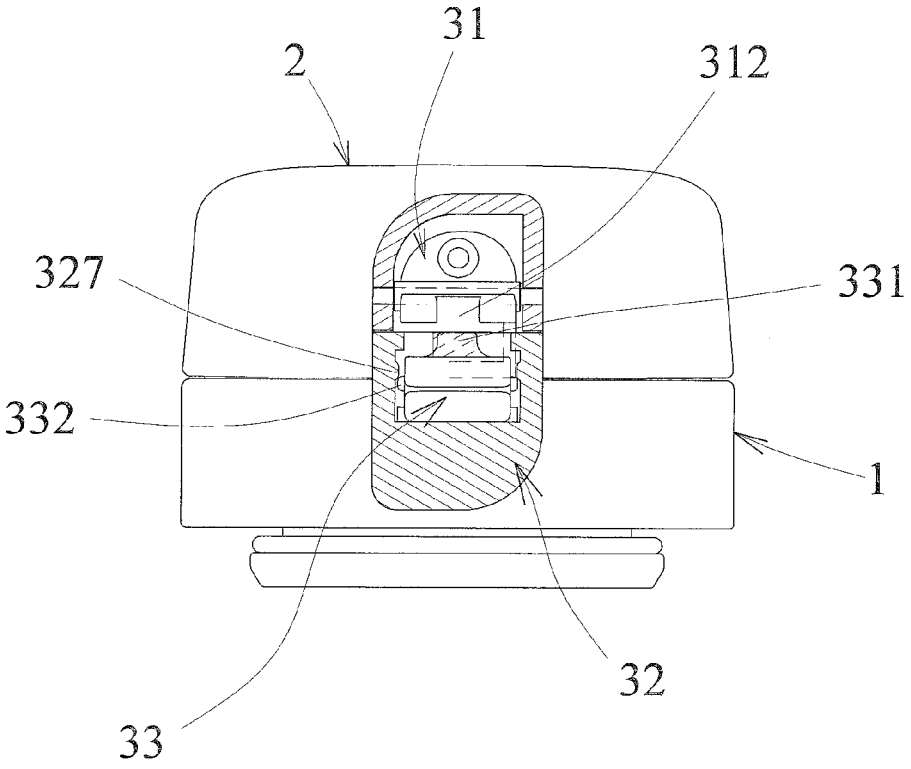
FIG. 7 is a diagram showing a front view of the relation between the first latch seat, the second latch seat, and the sliding latch bolt after moving down the sliding latch bolt.
Figure 8:
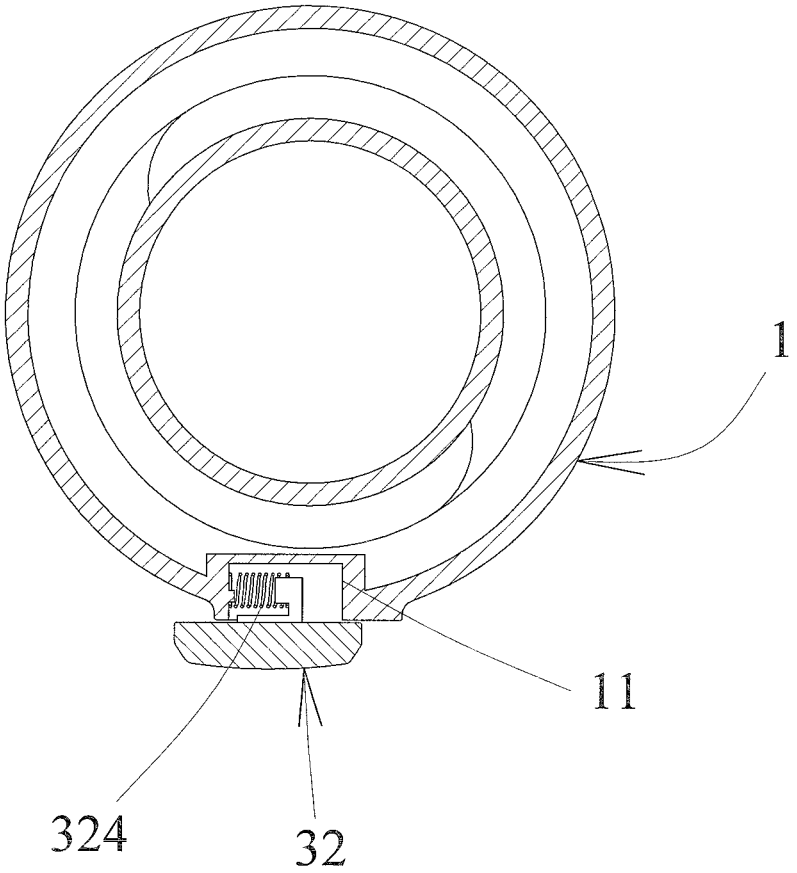
FIG. 8 is a diagram showing a top view of the relation between the first latch seat, the second latch seat, and the sliding latch bolt after horizontally moving the second latch seat.
Figure 9:
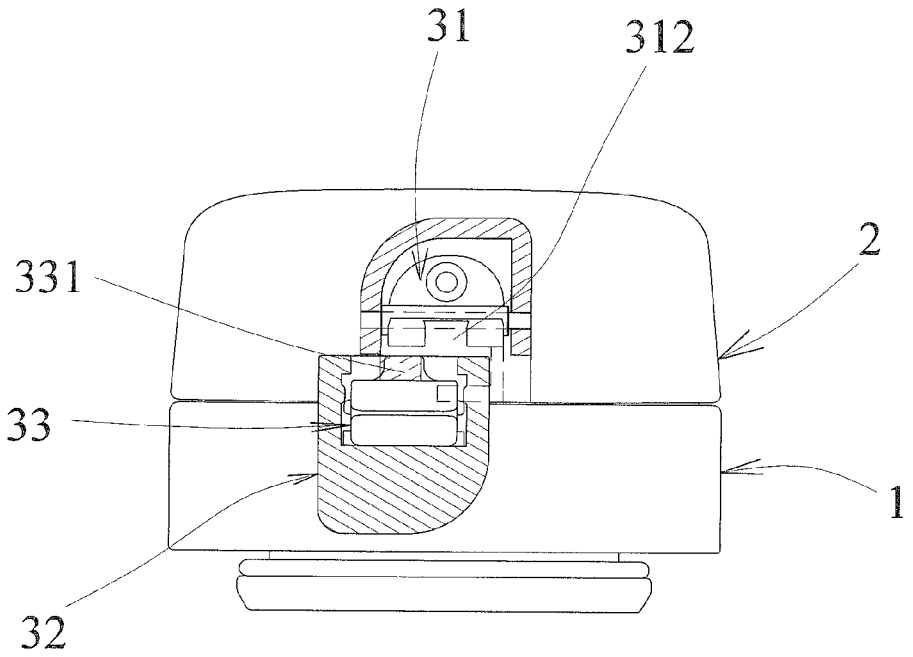
FIG. 9 is a diagram showing a front view of the relation between the first latch seat, the second latch seat, and the sliding latch bolt after horizontally moving the second latch seat.
Figure 10:
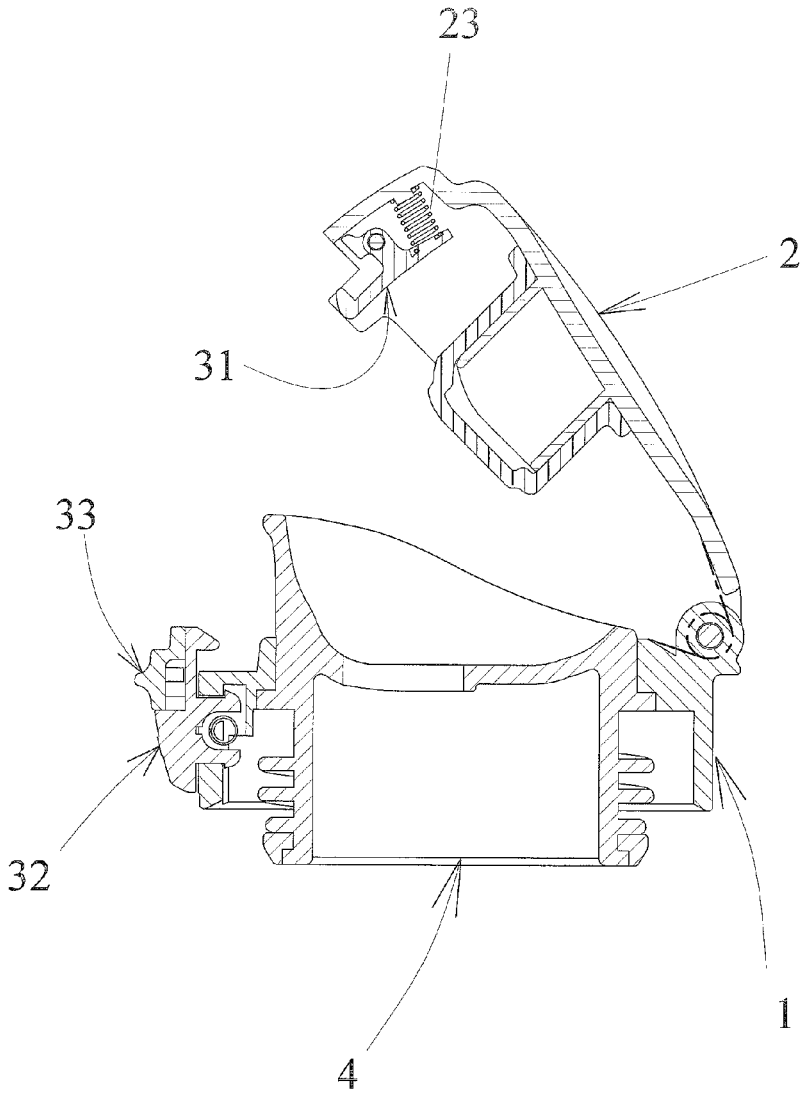
FIG. 10 is a diagram showing a lateral view of opening the top cover.

Please refer to FIGS. 3-5. When the top cover 2 simultaneously covers the bottom cover 1 and the outlet 41 of the watering seat 4 assembled on the opening of the container's body is closed, the second buckle hook 321 of the second latch seat 32 is in the first position. Thus, the first buckle hook 311 of the first latch seat 31 and the second buckle hook 321 of the second latch seat 32 are correspondingly hooked to latch the top cover 2 and the bottom cover 1. At the same time, the slide latch bolt 33 is in the third position, hence the cog 331 of the slide latch bolt 33 is correspondingly plugged in the slot 312 of the first latch seat 31 to latch the second latch seat 32. Thus, the top cover 2 cannot be released from the bottom cover 1.

Please refer to FIGS. 6-10. When the top cover 2 is to be opened, a finger can be used to move down the sliding latch bolt 33. Accordingly, the second bumps 332 of the sliding latch bolt 33 move across the first bumps 327 of the second latch seat 32. It means that the sliding latch bolt 33 moves from the latched third-position to the unlatched fourth-position. Next, the finger can horizontally move the second latch seat 32 to let the second buckle hook 321 of the second latch seat 32 detach from the first hook 311 of the first latch seat 31. That is, the second latch seat 32 moves from the latched first-position to the unlatched second-position to completely release the top cover 2 from the bottom cover 1, and the top cover 2 is thus opened.

The second elastic element 324 is disposed between the second latch seat 32 and the through slot 11 of the bottom cover 1. Therefore, if no force is applied on the second latch seat 32 to horizontally move the second latch seat 32, the second latch seat 32 will move from the unlatched second-position to the latched first-position for waiting the user presses the top cover 2 and thus the top cover 2 covers on the bottom cover 1.

The first elastic element 23 is disposed between the first end of the first latch seat 31 and the inner sidewalls of the room 21 of the top cover 2. Thus, the second end of the first latch seat 31 has an elasticity of rotating the pivot 22. Accordingly, when a user presses the top cover 2, the first buckle hook 311 of the first latch seat 31 can be guided by the inclined surface of the second buckle hook 321 of the second latch seat 32 to easily cross the second buckle hook 321 and hook with the second buckle hook 321, and the top cover 2 can thus cover on the bottom cover 1. At this time, for ensuring that the top cover 2 covering on the bottom cover 1 will not be opened by inadvertently touching the second latch seat 32. Therefore, the sliding latch bolt 33 is moved upward and let the second bumps 332 of the sliding latch bolt 33 cross the first bumps 327 of the second latch seat 32. It means that the sliding latch bolt 33 is moved from the unlatched fourth-position to the latched third-position. Therefore, the top cover 2 can be ensured to cover on the bottom cover 1 and is not opened by inadvertently touching the second latch seat 32.

What is claimed is:

1. A cover structure of a container, comprising:

a bottom cover assembled on an opening of a body of the container;

a top cover pivotally connected with the bottom cover to simultaneously cover the bottom cover and an outlet of a watering seat assembled on the opening of the body of the container; and a latch mechanism disposed between the top cover and the bottom cover and comprising:

a first latch seat assembled on the top cover, wherein the first latch seat has a first buckle hook and a slot;

a second latch seat elastically and horizontally movably assembled between a first position and a second position of the bottom cover, wherein the second latch seat has a second buckle hook to be hooked with the first buckle hook when the second latch seat is positioned in the first position, and the second buckle hook is detached from the first buckle hook when the second latch seat is positioned in the second position; and a sliding latch bolt vertically slidably assembled between a third position and a fourth position of the second latch seat, wherein the sliding latch bolt comprises a cog inserted into the slot when the sliding latch bolt is positioned in the third position, and the cog is detached from the slot when the sliding latch bolt is positioned in the fourth position.

2. The cover structure of claim 1, wherein the top cover comprises:

an opening toward a room of the bottom cover, wherein the room receives the first latch seat;

a pivot horizontally penetrating a right sidewall and a left sidewall of the room, as well as the first latch seat; and a first elastic element assembled between a front sidewall of the room and a first end of the first latch seat, and the first buckle hook and the slot located on a second end of the first latch seat, which is opposite to the first end of the first latch seat.

3. The cover structure of claim 2, wherein the first buckle hook projects from the room to be exposed.

4. The cover structure of claim 3, wherein the bottom cover comprises:

a through slot penetrating the walls of the bottom cover;

two hooks disposed on terminal surfaces of the second latch seat toward the through slot to extend into the through slot and hook the top and bottom peripheral edges of the through slot; and a second elastic element disposed in a space formed between the two hooks and having two terminals respectively against the sidewalls of the through slot and the second latch seat.

5. The cover structure of claim 4, wherein the sidewalls of the through slot have positioning bumps disposed thereon to be respectively sleeved in two terminals of the second elastic element.

6. The cover structure of claim 5, wherein the second latch seat has a recessed slot disposed on a surface opposite to the terminal surface of the through slot for receiving the sliding latch bolt.

7. The cover structure of claim 6, wherein the recessed slot comprises two sliding grooves respectively disposed on a right sidewall and a left sidewall of the recessed slot, and first bumps disposed in the sliding grooves to divide the sliding grooves into the third position and the fourth position; and wherein the sliding latch bolt comprises second bumps disposed on a left sidewall and a right sidewall of the sliding latch bolt to be correspondingly located in the sliding grooves, and the second bumps can across the first bumps to reach the third and fourth positions.

8. The cover structure of claim 4, wherein the second latch seat has a recessed slot disposed on a surface opposite to the terminal surface of the through slot for receiving the sliding latch bolt.

9. The cover structure of claim 8, wherein the recessed slot comprises two sliding grooves respectively disposed on a right sidewall and a left sidewall of the recessed slot, and first bumps disposed in the sliding grooves to divide the sliding grooves into the third position and the fourth position; and wherein the sliding latch bolt comprises second bumps disposed on a left sidewall and a right sidewall of the sliding latch bolt to be correspondingly located in the sliding grooves, and the second bumps can across the first bumps to reach the third and fourth positions.

10. The cover structure of claim 1, wherein the second latch seat has a recessed slot disposed on a surface opposite to the terminal surface of the through slot for receiving the sliding latch bolt.

11. The cover structure of claim 10, wherein the recessed slot comprises two sliding grooves respectively disposed on a right sidewall and a left sidewall of the recessed slot, and first bumps disposed in the sliding grooves to divide the sliding grooves into the third position and the fourth position; and wherein the sliding latch bolt comprises second bumps disposed on a left sidewall and a right sidewall of the sliding latch bolt to be correspondingly located in the sliding grooves, and the second bumps can across the first bumps to reach the third and fourth positions.

12. The cover structure of claim 1, wherein the bottom cover comprises:

a through slot penetrating the walls of the bottom cover;

two hooks disposed on terminal surfaces of the second latch seat toward the through slot to extend into the through slot and hook the top and bottom peripheral edges of the through slot; and a second elastic element disposed in a space formed between the two hooks and having two terminals respectively against the sidewalls of the through slot and the second latch seat.

13. The cover structure of claim 12, wherein the sidewalls of the through slot have positioning bumps disposed thereon to be respectively sleeved in two terminals of the second elastic element.

14. The cover structure of claim 13, wherein the second latch seat has a recessed slot disposed on a surface opposite to the terminal surface of the through slot for receiving the sliding latch bolt.

15. The cover structure of claim 14, wherein the recessed slot comprises two sliding grooves respectively disposed on a right sidewall and a left sidewall of the recessed slot, and first bumps disposed in the sliding grooves to divide the sliding grooves into the third position and the fourth position; and wherein the sliding latch bolt comprises second bumps disposed on a left sidewall and a right sidewall of the sliding latch bolt to be correspondingly located in the sliding grooves, and the second bumps can across the first bumps to reach the third and fourth positions.

* * * * *